United States Patent [19]

Carter, Jr.

[11] 4,372,562

[45] Feb. 8, 1983

[54] INFLATABLE PACKER WITH LIQUID RESIN ANCHORED REINFORCING SHEATH

[75] Inventor: Ernest E. Carter, Jr., Duncan, Okla.

[73] Assignee: Halliburton Company, Duncan, Okla.

[21] Appl. No.: 300,507

[22] Filed: Sep. 9, 1981

[51] Int. Cl.[3] ..... F16J 15/46; E21B 33/12

[52] U.S. Cl. ..... 277/34; 277/1; 277/9; 277/31; 277/230; 166/120; 166/187; 285/294

[58] Field of Search ..... 277/1, 9, 9.5, 34, 34.3, 277/120, 34.6, 31, 116.2, 32, 229, 121, 230, 116.6; 166/120–122, 179, 187, 315; 285/294, 297

[56] References Cited

U.S. PATENT DOCUMENTS

| | | | |
|---|---|---|---|
| 3,837,947 | 9/1974 | Malone | 277/34 X |
| 4,153,656 | 5/1979 | Bungan | 285/294 X |
| 4,191,383 | 3/1980 | Baker et al. | 277/1 |
| 4,260,164 | 4/1981 | Baker et al. | 277/34 |

FOREIGN PATENT DOCUMENTS

| | | | |
|---|---|---|---|
| 511226 | 3/1955 | Canada . | |
| 607029 | 10/1960 | Canada . | |
| 2303261 | 10/1976 | France | 277/1 |
| 1536682 | 12/1978 | United Kingdom | 277/1 |

OTHER PUBLICATIONS

Exhibit A to Prior Art Statement, TAM International, Houston, Tex., No Date Given, No Publication Number, One Page Copy of Photograph.

*Primary Examiner*—Robert S. Ward, Jr.
*Attorney, Agent, or Firm*—Lucian Wayne Beavers; Joseph A. Walkowski; Thomas R. Weaver

[57] ABSTRACT

An inflatable packer includes a reinforcing element constructed from first and second layers of alternately biased calendered steel cables. Fixed and sliding end shoes each are a single machined structure and include a roughened inner cylindrical surface disposed about an end of the reinforcing element. Upper and lower hardened rings, formed from a liquid adhesive, have the ends of the reinforcing element embedded therein and are bonded to the end shoes.

12 Claims, 7 Drawing Figures

INFLATABLE PACKER WITH LIQUID RESIN ANCHORED REINFORCING SHEATH

This invention relates generally to an inflatable packer assembly for sealing an annular cavity about a well casing or other tubular element.

An inflatable packer is a downhole tool which can be inflated with well fluid to seal off the annular space between, for example, the casing and the wellbore. It may also be used inside a casing as a retrievable packer.

Inflatable packers may be used in a well for a variety of reasons. They can be used to support a column of cement above a lost circulation zone. They can be used to isolate producing zones from cement contact. At times they are used to centralize a casing during cementing operations. Also, they may be used to isolate production and lost circulation zones for gravel pack operations.

The inflatable packer of the present invention is a modified version of the inflatable packer shown in U.S. Pat. No. 4,191,383 of Baker et al., assigned to the assignee of the present invention, and particularly provides improvements in the construction of the end shoes, the construction of the reinforcing element, and the manner of attaching the ends of the reinforcing element to the end shoes.

The inflatable packer of the present invention includes an inflatable packer element having an inflatable bladder means with a reinforcing element. An end shoe includes an annular anchor means and is constructed in the form of a single machined structure. The anchor means includes a roughened cylindrical inner surface concentrically disposed about an end portion of the reinforcing element. The reinforcing element is constructed from two layers of alternately biased calendered steel cables. A hardened ring is formed from a liquid adhesive and has the end of the reinforcing element embedded therein. The hardened ring has a radially outer surface conforming to and bonded to the roughened cylindrical inner surface of the anchor means. Preferably the anchor means also includes a radially inwardly projecting annular shoulder, which is engaged by a longitudinally inner end of the hardened ring so that when a tension load is placed on the reinforcing element a portion of the load is transferred by the hardened ring in compression against the shoulder of the anchor means.

A more simple and more economical construction is provided as compared to the structure disclosed in U.S. Pat. No. 4,191,383, in that the end shoes are each constructed from a single machined structure, as compared to the apparatus of U.S. Pat. No. 4,191,383 wherein the end shoe is formed from three separately machined and subsequently assembled parts.

Also, the present construction provides a structure wherein the wall of the inflatable packer element may be made thinner than the construction of U.S. Pat. No. 4,191,383, and this is often very advantageous for special clearance applications.

The one-piece end shoe design eliminates the sliding seals of the end shoe design of U.S. Pat. No. 4,191,383 thus eliminating the possiblity of leakage.

Further, the calendered cable construction provides increased strength and reliability during inflation thus allowing high inflation pressures to be used.

Numerous objects, features and advantages of the present invention will be readily apparent to those skilled in the art upon a reading of the following disclosure when taken in conjunction with the accompanying drawings.

FIGS. 1A and 1B jointly comprise a somewhat schematic elevation partly sectioned view of an inflation packer.

FIGS. 2A and 2B jointly comprise a sectioned elevation view of an inflatable packer element for use on a packer like that shown in FIG. 1, and particularly adapted for service as a casing packer.

Figure 1A:
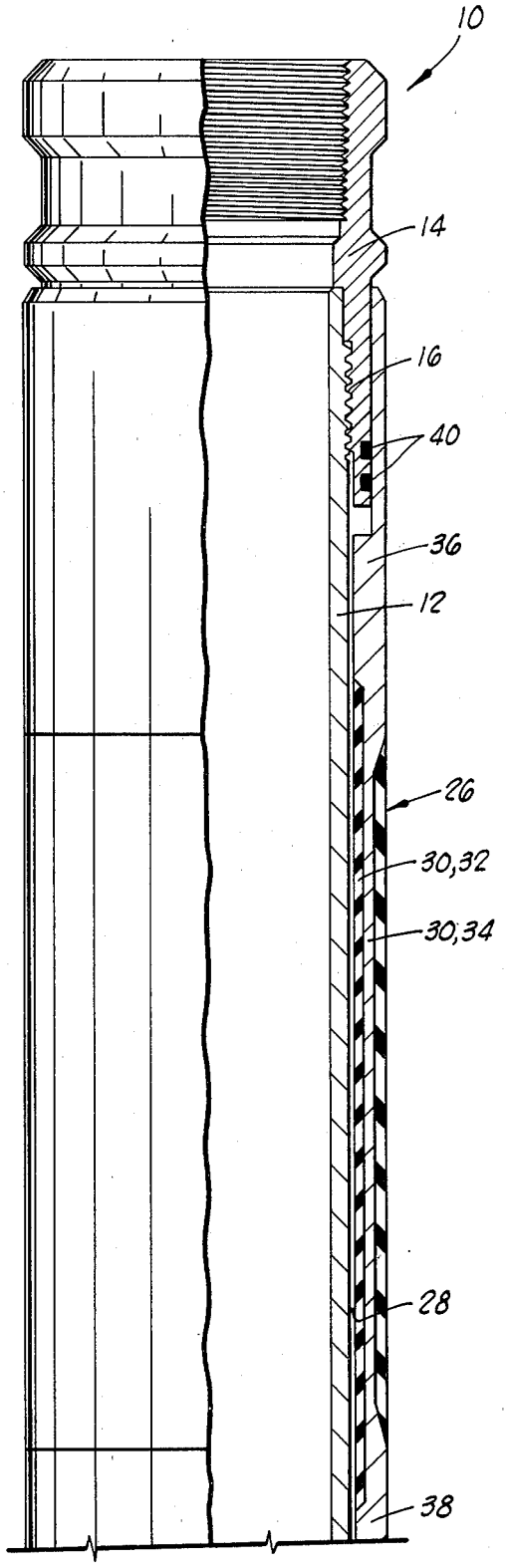
Figure 1B:
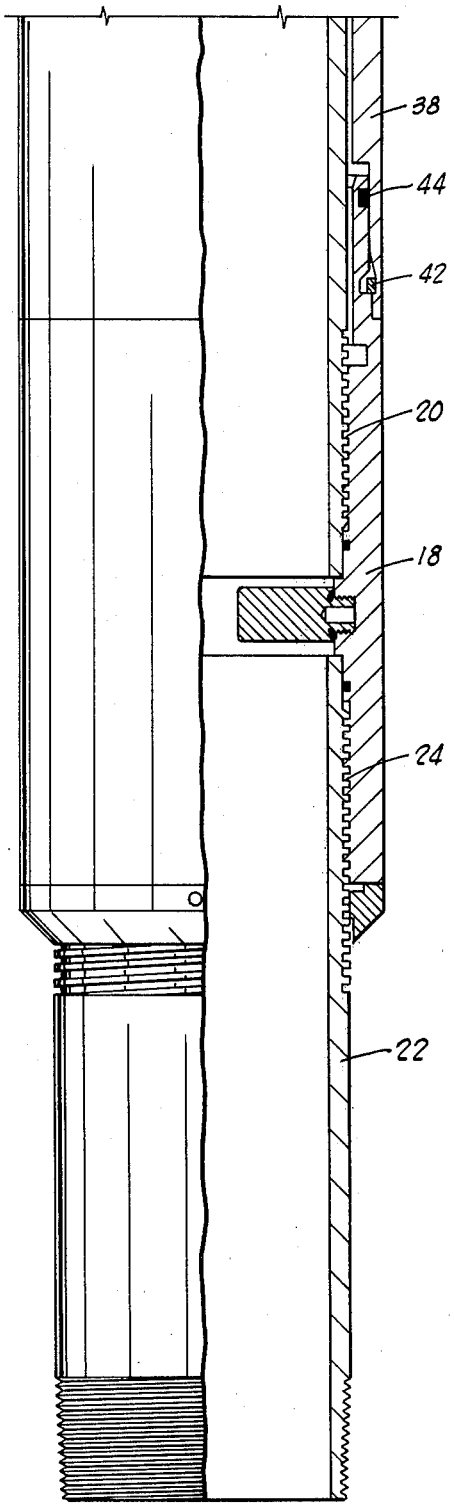

Referring now to the drawings, and particularly to FIG. 1, the inflation packer of the present invention is shown and generally designated by the numeral 10.

The packer 10 includes a packer mandrel 12 having an upper body 14 attached to an upper end thereof at threaded connection 16.

A valve assembly 18 is attached to a lower part of packer mandrel 12 at threaded connection 20. A lower body 22 is attached to the lower end of valve assembly 18 at threaded connection 24. The valve assembly 18 is shown schematically only, and may be constructed in a manner similar to that disclosed in U.S. Pat. No. 4,260,164 Baker et al., assigned to the assignee of the present invention which disclosure is incorporated herein by reference.

Generally, the valve assembly 18 provides a means for directing well fluid under pressure to an inflatable packer element generally designated by the numeral 26.

The inflatable packer element 26 is disposed about packer mandrel 12 and there is a slight annular clearance 28 therebetween for receiving the well fluid under pressure from valve means 18 to inflate the inflatable packer 26.

The inflatable packer element 26 is shown very schematically in FIG. 1. Packer element 26 includes an inflatable bladder means 30 having an elastomeric bladder element 32 and having a reinforcing element 34 disposed about the elastomeric element 32. The upper end of the inflatable bladder means 30 is attached to an upper sliding end shoe 36, and the lower end of the inflatable bladder means 30 is attached to a fixed lower end shoe 38.

The sliding end shoe 36 slidingly engages upper body 12 and a sliding seal is provided therebetween by seal means 40.

The fixed end shoe 38 is fixedly attached to valve means 18 by a lock ring 42, and a fixed seal is provided by seal means 44.

When well fluid under pressure is directed by valve means 18 to clearance 28, the inflatable bladder means 30 inflates thus expanding in diameter, and the sliding end shoe 36 moves downward relative to upper body 14, in a manner well known to those skilled in the art.

Figure 2A:
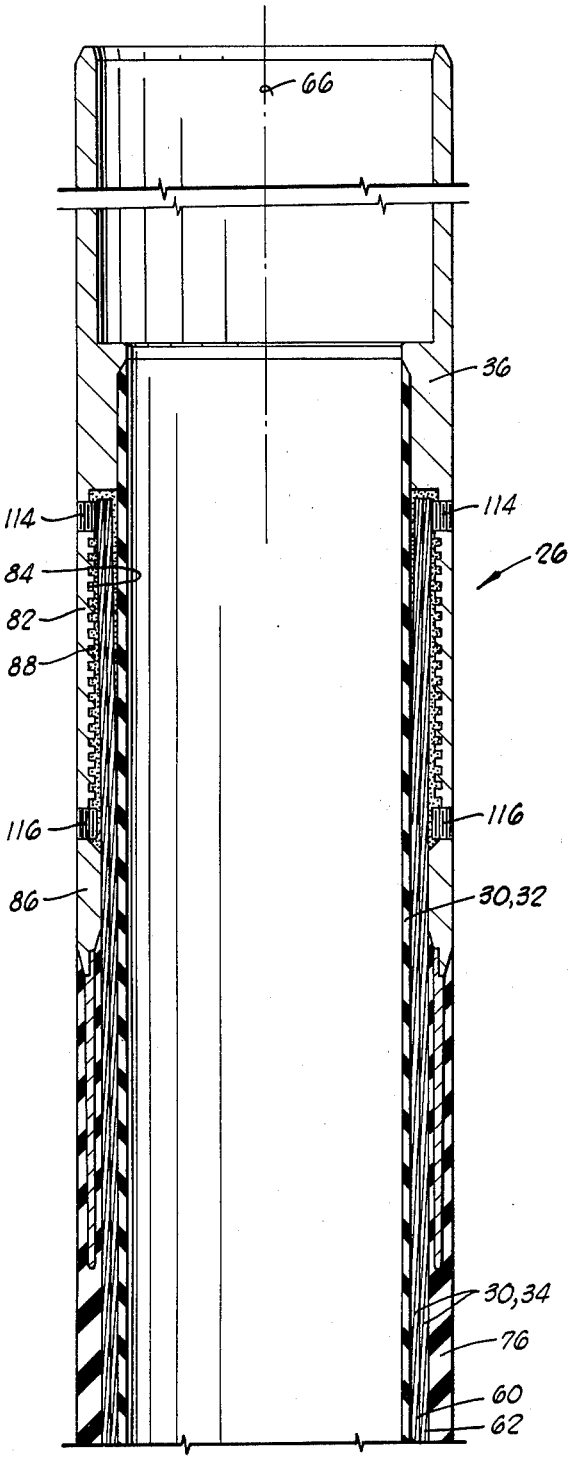
Figure 2B:
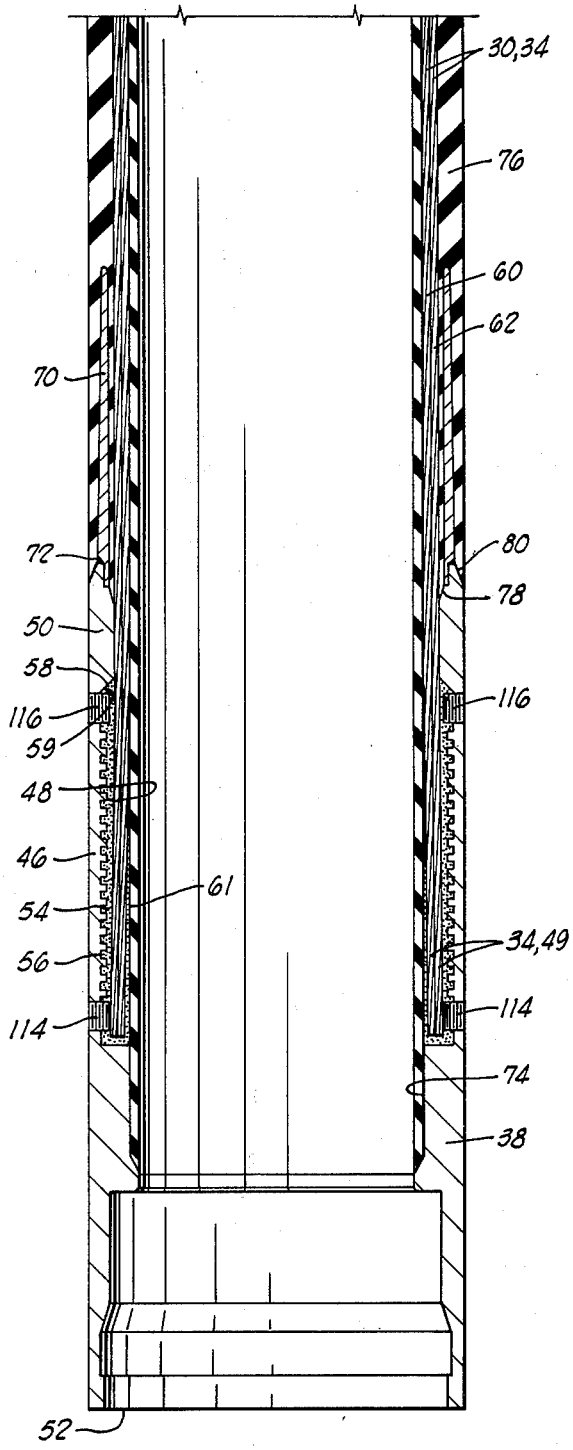
Figure 3:
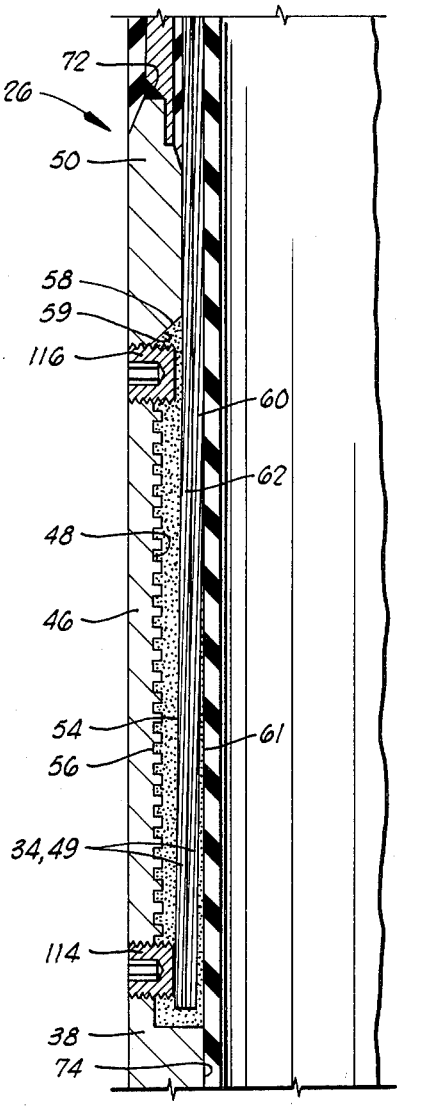
FIG. 3 is an enlarged section elevation view of a portion of the packer element of FIG. 2B showing in more detail the hardened ring joining the end of the reinforcing element to the anchor means.

Referring now to FIGS. 2A and 2B, and to FIG. 3, a more detailed view is thereshown of the inflatable packer element 26.

The fixed lower end shoe 38 includes a lower annular anchor means 46 which includes a roughened cylindrical inner surface 48 concentrically disposed about a lower end portion 49 of the reinforcing element 34. The roughened surface 48 is formed by threading a cylindrical inner surface, but the use of threads is merely a convenient manner of providing a roughened surface.

The lower anchor means 46 also includes a radially inwardly projecting annular shoulder 50.

The shoulder 50 may be described as being located above the roughened inner cylindrical surface 48, or may more generally be described as being located longitudinally inward of the surface 48. The term "longitudinally inward", with regard to the inflatable packer element 26, indicates a direction toward the inflatable element 26 away from the nearest end such as lower end 52.

A lower hardened ring 54, formed from a liquid adhesive such as epoxy resin, has the lower end portion 49 of reinforcing element 34 embedded therein and includes a radially outer surface 56 conforming to and bonded to roughened cylindrical inner surface 48 of anchor means 46.

The hardened ring 54 also includes an upper or longitudinally inner end 58 engaging a downward facing surface 59 of shoulder 50 of anchor means 46, so that when a tension load is placed on reinforcing element 34 a portion of said load is transferred by said lower hardened ring 54 in compression against surface 59 of shoulder 50 of anchor means 46 of fixed end shoe 38.

A radially inner cylindrical surface 61 of lower hardened ring 54 is free from any load bearing attachment to end shoe 38 so that substantially all of the tension load placed on reinforcing element 34 is transferred by hardened ring 54 to the roughened cylindrical inner surface 48 and the shoulder 50 of anchor means 46.

Figure 5:
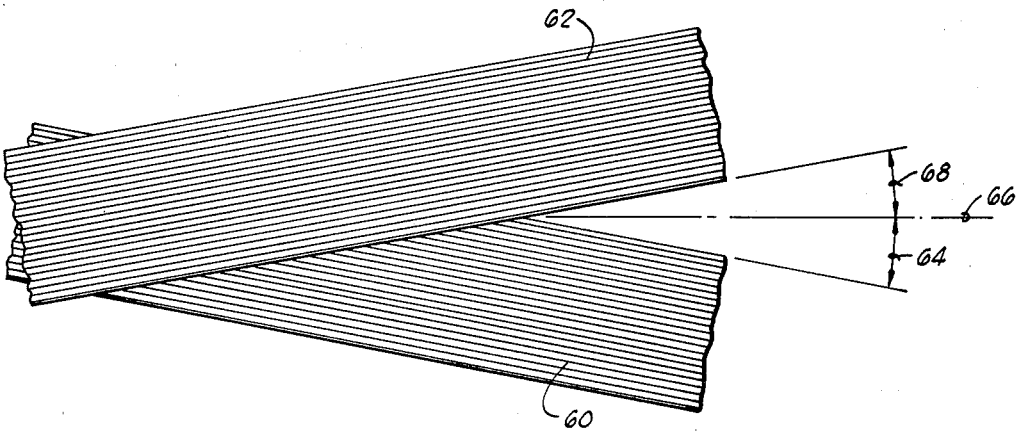
FIG. 5 is a somewhat schematic view illustrating the alternate bias of the two layers of calendered cables which make up the reinforcing element.

The reinforcing element 34 includes first and second layers 60 and 62 of steel cables. As is best seen in FIG. 5, the cables of first layer 60 are angularly biased in a first angular direction 64 relative to a longitudinal center line 66 of reinforcing element 26, and the cables of second layer 62 are angularly biased in a second angular direction 68 opposite said first angular direction 64. Preferably, angles 64 and 68 are each approximately 10° so that there is a 20° included angle between the cables of layers 60 and 62.

The lower fixed end shoe 38 and the anchor means 46 thereof are integrally constructed and comprise a single machined structure as can be readily seen in FIGS. 2A and 2B.

A lower annular brass expanding sleeve 70 is welded to anchor means 46 by magnesium bronze welding as indicated at 72. The lower brass expanding sleeve 70 extends upward from anchor means 46, and as will be understood by those skilled in the art, the expanding sleeve 70 provides structural support to the inflatable bladder means when the inflatable bladder means is expanded so as to bridge an annulus between the packer 10 and the wellbore hole within which it is located.

The elastomeric bladder element 32 of inflatable bladder means 30 is bonded to a portion 74 of fixed end shoe 38 located below or longitudinally outward from the hardened ring 54.

An elastomeric cover 76 is disposed about reinforcing element 34 and has a lower end bonded to anchor means 46 at locations 78 and 80 which are radially inward of and radially outward of, respectively, the connection between brass expanding sleeve 70 and anchor means 48.

The sliding upper end shoe 36 is attached to an upper end portion of reinforcing element 34 in a manner similar to that just described for the fixed lower end shoe 38, and includes an upper anchor means 82, having a roughened inner cylindrical surface 84 and having a radially inward projecting shoulder 86.

An upper hardened ring 88 has the upper end portion of reinforcing element 34 embedded therein and is bonded to anchor means 82.

Figure 4:
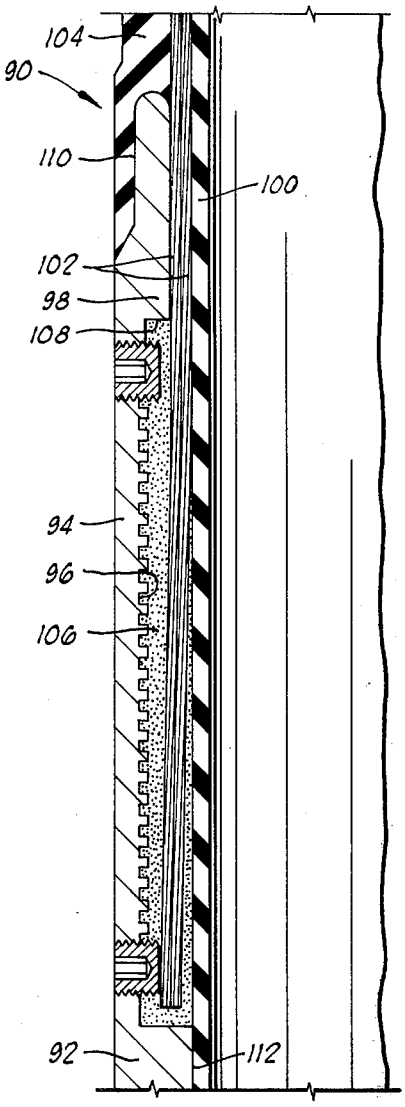
FIG. 4 is a sectional elevation partial view similar to FIG. 3 of an inflatable packer element modified as compared to that of FIGS. 2 and 3, and particularly adapted for use as a retrievable packer.

Referring now to FIG. 4, a somewhat modified version of the invention is thereshown and particularly includes an inflatable packer element 90 adapted for use as a retrievable packer as opposed to a casing packer. As mentioned, the inflatable packer element 26 of FIGS. 2 and 3 is particularly adapted for use as a casing packer.

The inflatable packer element 90 of FIG. 4 is only partially shown, in a manner similar to FIG. 3, and includes a lower fixed end shoe 92 having an annular anchor means 94 which includes a roughened cylindrical inner surface 96 and a radially upward projecting shoulder 98.

The packer element 90 includes an elastomeric bladder element 100, a reinforcing element 102, and an elastomeric cover 104.

A lower hardened ring 106 has the lower end portion of the reinforcing element 102 embedded therein and is bonded to cylindrical inner surface 96 and a downward facing surface 108 of shoulder 98.

The function of the hardened ring 106 is the same as that of the hardened rings of FIGS. 2 and 3.

The difference of the structure of the retrievable packer 96 of FIG. 4 as compared to the casing packer of FIGS. 2 and 3, is that the anchor means 94 has been somewhat changed in the shape and dimensions of the shoulder 98 as illustrated. Also, the brass expanding shoe has been eliminated.

Otherwise, the inflatable retrievable packer element 90 is similar to that of the packer element 26. The cover 104 is bonded to the anchor means 94 at 110. The elastomeric bladder element is bonded to the fixed shoe at 112.

The preferred manner of construction of the inflatable packer element 26 is generally as follows. The inflatable packer element 90 of FIG. 4 is constructed in a similar manner.

The elastomeric bladder element 32 is wrapped about a mandrel from several layers of natural rubber and is precured.

Then, the layers 60 and 62 of cables forming the reinforcing element 34 are laid up either parallel by hand, or preferably in the form of calendered cable with a 10° bias angle to center line. Preferably a layer of soft rubber (not shown) is bonded between the layers 60 and 62 and another layer (not shown) of soft rubber is laid above the top layer 62. The cables of layers 60 and 62 should be bonded to the elastomeric bladder element 32 if possible.

The end shoes 36 and 38 with the expandable brass sleeves welded thereto are then installed so that the upper and lower ends of the reinforcing element 34 are concentrically received within the upper and lower anchor means 82 and 46.

Then the outer cover 76 is built up and the packer is put in the curing oven to bond the elastomeric bladder element 32 and the cover 76 to the end shoes in the locations previously mentioned.

While the packer is still hot from the curing oven, warm epoxy resin is injected at the locations of longitudinally outward pipe plugs such as 114. The liquid epoxy resin surrounds the upper and lower ends of reinforcing element 34 and extends to the longitudinally outward facing surfaces such as 59 of the shoulders 50 and 86 and flows out the longitudinally inner openings which are shown in FIG. 2 as being covered by pipe plugs such as 116. Of course, the pipe plugs 114 and 116 are removed during the epoxy injection operation and are replaced after the epoxy fills the space indicated in the drawings.

Thus it is seen that the inflation packer of the present invention readily achieves the ends and advantages mentioned as well as those inherent therein. While certain preferred embodiments have been illustrated for the purpose of the present disclosure, numerous changes in that arrangement and construction may be made by those skilled in the art which changes are encompassed within the scope and spirit of the present invention as defined by the appended claims.

What is claimed is:

1. An inflatable packer element, comprising:

an inflatable bladder means including a reinforcing element;

an end shoe including an annular anchor means, said anchor means including a roughened cylindrical inner surface concentrically disposed about an end portion of said reinforcing element and including a radially inward projecting annular shoulder located longitudinally inward of said roughened cylindrical inner surface;

a hardened ring formed from a liquid adhesive, said ring having said end portion of said reinforcing element embedded therein, said ring having a radially outer surface conforming to and bonded to said roughened cylindrical inner surface of said anchor means, and said ring having a longitudinally inner end engaging said shoulder of said anchor means, so that when a tension load is placed on said reinforcing element a portion of said load is transferred by said ring in compression against said shoulder of said anchor means and;

wherein a radially inner cylindrical surface of said hardened ring is free from any load bearing attachment to said end shoe, so that substantially all of said tension load on said reinforcing element is transferred by said hardened ring to said roughened cylindrical inner surface and said shoulder of said anchor means.

2. The inflatable packer element of claim 1, wherein: said liquid adhesive is an epoxy resin.

3. The inflatable packer element of claim 1, wherein: said reinforcing element includes first and second layers of steel cables, each of said layers including a plurality of parallel cables, the cables of said first layer being angularly biased in a first angular direction relative to a longitudinal centerline of said reinforcing element, and the cables of said second layer being angularly biased in a second angular direction opposite said first angular direction.

4. The inflatable packer element of claim 1, wherein: said end shoe and said anchor means thereof are integrally constructed and comprise a single machined structure.

5. The inflatable packer element of claim 4, further comprising:

an annular brass expanding sleeve welded to and extending longitudinally inward from said anchor means.

6. The inflatable packer element of claim 5, wherein: said inflatable bladder means includes an elastomeric bladder element having said reinforcing element disposed thereabout, an end of said elastomeric bladder element being bonded to a portion of said end shoe located longitudinally outward from said hardened ring.

7. The inflatable packer element of claim 6, further comprising:

an elastomeric cover disposed about said reinforcing element and having an end bonded to said anchor means.

8. An inflation packer, comprising:

a packer mandrel;

an upper body attached to an upper end of said packer mandrel;

a valve assembly attached to a lower part of said packer mandrel; and an inflatable packer element disposed about said packer mandrel, said packer element including:

an inflatable bladder means including a reinforcing element, said reinforcing element including first and second layers including a plurality of parallel cables, the cables of said first layer being angularly biased in a first angular direction relative to a longitudinal centerline of said reinforcing element, and the cables of said second layer being angularly biased in a second angular direction opposite said first angular direction;

a sliding end shoe slidably engaging said upper body and including an upper annular anchor means, said anchor means including a roughened cylindrical inner surface concentrically disposed about an upper end portion of said reinforcing element, said sliding end shoe and said anchor means thereof being integrally constructed and comprising a single machined structure;

an upper hardened ring formed from a liquid adhesive, said upper hardened ring having said upper end portion of said reinforcing element embedded therein, and said upper hardened ring having a radially outer surface conforming to and bonded to said roughened cylindrical inner surface of said anchor means of said sliding end shoe;

a fixed end shoe attached to said valve assembly and including a lower annular anchor means, said lower anchor means including a roughened cylindrical inner surface concentrically disposed about a lower end portion of said reinforcing element, said fixed end shoe and said anchor means thereof being integrally constructed and comprising another single machined structure;

a lower hardened ring formed from said liquid adhesive, said lower hardened ring having said lower end portion of said reinforcing element embedded therein, and said lower hardened ring having a radially outer surface conforming to and bonded to said roughened cylindrical inner surface of said lower anchor means and;

wherein a radially inner cylindrical surface of each of said hardened rings is free from any load bearing attachment to said end shoes.

9. The packer of claim 8, wherein:

said upper anchor means includes an upper radially inward projecting shoulder located below and engaging a lower end of said upper hardened ring, and said lower anchor means includes a lower radially inward projecting shoulder located above and engaging an upper end of said lower hardened ring, said upper and lower anchor means and hardened rings being so arranged and constructed that when a tension load is placed on said reinforcing element a portion of said load is transferred by said hardened rings in compression against said shoulders of said anchor means.

10. The packer of claim 8, further comprising:

an upper annular brass expanding sleeve welded to and extending downward from said upper anchor means; and a lower annular brass expanding sleeve welded to and extending upward from said lower anchor means.

11. The packer of claim 10, wherein:

said inflatable bladder means includes an elastomeric bladder element having said reinforcing element disposed thereabout, an upper end of said elastomeric bladder element being bonded to a portion of said sliding end shoe located above said upper hardened ring, and a lower end of said elastomeric bladder being bonded to a portion of said fixed end shoe located below said lower hardened ring.

12. The packer of claim 11, further comprising:

an elastomeric cover disposed about said reinforcing element and having upper and lower ends bonded to said upper and lower anchor means.

* * * * *